US011387552B2

(12) United States Patent
Li et al.

(10) Patent No.: US 11,387,552 B2
(45) Date of Patent: Jul. 12, 2022

(54) ASSEMBLY FOR ADJUSTING ELECTRICALLY REGULATED ANTENNA AND ELECTRICALLY REGULATED ANTENNA SYSTEM

(71) Applicant: CommScope Technologies LLC, Hickory, NC (US)

(72) Inventors: Mankun Li, Jiangsu (CN); Longquiang Xiao, Jiangsu (CN); Qiang Wang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/965,619

(22) PCT Filed: Jan. 28, 2019

(86) PCT No.: PCT/US2019/015408
§ 371 (c)(1),
(2) Date: Jul. 29, 2020

(87) PCT Pub. No.: WO2019/152310
PCT Pub. Date: Aug. 8, 2019

(65) Prior Publication Data

US 2021/0044016 A1 Feb. 11, 2021

(30) Foreign Application Priority Data

Feb. 1, 2018 (CN) ..... 201810104019.9

(51) Int. Cl.
*H01Q 1/32* (2006.01)
*H01Q 3/34* (2006.01)
(Continued)

(52) U.S. Cl.
CPC ..... *H01Q 3/32* (2013.01); *H01Q 1/246* (2013.01); *H01Q 3/34* (2013.01); *H01Q 1/526* (2013.01)

(58) Field of Classification Search
CPC ..... H01Q 3/32; H01Q 1/24; H01Q 1/246; H01Q 1/32; H01Q 1/52; H01Q 1/526; H01Q 3/34
See application file for complete search history.

(56) References Cited

U.S. PATENT DOCUMENTS 3,634,864 A * 1/1972 Trachtenberg ..... H01Q 1/1271 343/713
5,500,489 A * 3/1996 Shah ..... H01B 7/0838 174/117 A (Continued)

FOREIGN PATENT DOCUMENTS

| | | |
|---|---|---|
| EP | 0186517 | 3/1992 |
| WO | 2015/130670 | 9/2015 |
| WO | 2017/028700 | 2/2017 |

OTHER PUBLICATIONS

International Preliminary Report on Patentability corresponding to International Application No. PCT/US2019/015408 dated Aug. 13, 2020.

(Continued)

*Primary Examiner* — Tho G Phan
(74) *Attorney, Agent, or Firm* — Myers Bigel, P.A.

(57) ABSTRACT

An assembly for adjusting an electrically regulated antenna includes a control device, a motor and a cable. The control device is connected with the motor via the cable, and a shielding material in the assembly for adjusting the electrically regulated antenna comprises alum-glass cloth tape. The shielding material composed of the alum-glass cloth tape is used for improving the electromagnetic shielding effect, particularly the passive intermodulation effect, of an (Continued)

electrically regulated antenna system. The invention further relates to a method for manufacturing the assembly for adjusting the electrically regulated antenna.

10 Claims, 12 Drawing Sheets

(51) Int. Cl.

| | |
|---|---|
| ***H01Q 3/32*** | (2006.01) |
| ***H01Q 1/24*** | (2006.01) |
| *H01Q 1/52* | (2006.01) |

(56) References Cited

U.S. PATENT DOCUMENTS

| | | | | |
|---|---|---|---|---|
| 5,600,333 | A * | 2/1997 | Justice | H01Q 1/1285 343/713 |
| 5,900,589 | A * | 5/1999 | Brunt | H01B 7/0018 174/120 R |
| 6,087,996 | A * | 7/2000 | Dery | H01Q 9/285 343/700 MS |
| 6,211,831 | B1 * | 4/2001 | Nagy | H01Q 1/1271 343/700 MS |
| 6,653,570 | B1 | 11/2003 | Elrod | |
| 9,549,778 | B2 * | 1/2017 | Shiu | H01Q 1/44 |
| 2010/0066625 | A1 * | 3/2010 | Kazanchian | H01Q 23/00 343/787 |
| 2015/0201380 | A1 | 7/2015 | Jakab et al. | |
| 2016/0344466 | A1 | 11/2016 | Zhan et al. | |

OTHER PUBLICATIONS

International Search Report and Written Opinion corresponding to International Application No. PCT/US2019/015408 dated May 14, 2019.

* cited by examiner

ASSEMBLY FOR ADJUSTING ELECTRICALLY REGULATED ANTENNA AND ELECTRICALLY REGULATED ANTENNA SYSTEM

RELATED APPLICATIONS

The present application is a 35 U.S.C. § 371 national phase application of and claims priority to PCT Application PCT/US2019/015408 filed Jan. 28, 2019, which claims priority from and the benefit of Chinese Patent Application No. 201810104019.9, filed Feb. 2, 2018, the disclosure of each of which is hereby incorporated herein by reference in full in its entirety.

FIELD OF THE INVENTION

The present invention relates to the field of radio frequency products, in particular to an assembly for adjusting an electrically regulated antenna and an electrically regulated antenna system with the assembly for adjusting the electrically regulated antenna. The present invention further relates to a method for manufacturing the assembly for adjusting the electrically regulated antenna.

BACKGROUND

With the large-scale construction of mobile communication networks (such as 3G and 4G), more and more standards and frequency bands are put into operation, the density of base stations is getting larger and larger, and intra-cell coverage and inter-cell interference become increasingly prominent. How to achieve good coverage is one of the hot spots of current research. Compared with the traditional mobile communication base station antenna, wherein the antenna needs to be adjusted by manually climbing a pole, the electrical downtilt of an electrically regulated antenna can be automatically adjusted at different time periods by using electronic control means, thereby optimizing the coverage of the electrically regulated antenna in real time and improving the utilization rate of network resources, thus the electrically regulated antenna has been applied more and more widely. The principle of the downward inclination of the electrically regulated antenna is: by changing the phase of a collinear array antenna element, changing the amplitudes of a vertical component and a horizontal component, and changing the field strength of a synthesized component, the vertical directivity pattern of the electrically regulated antenna inclines downward. The remote adjustment and monitoring of the electrical downtilt of the electrically regulated antenna are mainly achieved by the interaction of an electrically regulated antenna remote control unit (referred to as RCU) and an electrically regulated antenna system at present. The existing component for adjusting the electrically regulated antenna includes a printed circuit board (referred to as PCB), a motor and a corresponding transmission mechanism etc. A control signal is input to the printed circuit board via an AISG cable (Antenna Interface Standards Group, referred to as AISG) or an M12 connector and so on. The printed circuit board sends pulse signals to the motor, and the transmission mechanism converts the rotational motion of the motor into linear motion, and finally the electrical downtilt is adjusted by operating a phase shifter.

However, there is a series of passive intermodulation (PIM) sources (e.g., a motor shell, a motor cable, a metal seam, a crack, a whisker and the like) in the electrically regulated antenna system; especially in the assembly for adjusting the electrically regulated antenna. These PIM sources produce stray intermodulation signals, and when these stray intermodulation signals fall within the operation frequency band of the electrically regulated antenna, the SNR (Signal to Noise Ratio) of the system is reduced, and the capacity of the electrically regulated antenna system is reduced; thus, PIM becomes an important factor to limit the system capacity. Based on this, the implementation of electromagnetic shielding on the electrically regulated antenna system is typically necessary. However, the currently commonly used shielding material (electromagnetic shielding materials like magnesium, copper, nickel and aluminum) suffer from a series of drawbacks. For example, the shielding material is sufficiently thick to increase the tensile strength of the shielding material; however, this results in higher rigidity of the shielding material, such that the adhesion becomes worse, particularly when the object to be shielded is a flexible device; the shielding material is bent easily, so a gap is formed between the shielding material and the surface of the object to be shielded, and this will obviously reduce the electromagnetic shielding effect of the whole system. On the contrary, in order to achieve better adhesion, the thickness of the shielding material is reduced, which weakens the tensile strength of the shielding material, such that the shielding material is damaged or broken easily. Accordingly the electromagnetic shielding effect is greatly reduced, and as a result, the manufacturing and maintenance costs are increased.

SUMMARY

The present invention may improve the electromagnetic shielding effect, especially the passive intermodulation shielding effect, of an electrically regulated antenna system.

A first aspect of embodiments of the present invention relates to an assembly for adjusting an electrically regulated antenna, wherein the assembly for adjusting the electrically regulated antenna includes a control device, a motor and a cable, wherein the control device is connected with the motor via the cable, and a shielding material in the assembly for adjusting the electrically regulated antenna is composed of alum-glass cloth tape.

Herein, the control device is generally in a form of a printed circuit board, also referred to as a driven board, and a controller. A driven circuit, semiconductor switches and other electronic devices are generally integrated on the printed circuit board. The motor serving as an actuator for adjusting the electrically regulated antenna may be a DC motor, a brushless permanent magnet synchronous motor, a stepping motor; and the cable may be a flexible cable (for example, a flexible flat cable), a ribbon cable or the like.

It is known that there is a series of PIM sources (e.g. a motor shell, a motor cable, a metal seam, a crack, a whisker and the like) in the electrically regulated antenna system. PIM is caused by the nonlinear characteristics of a passive device, especially when the antenna is emitting outwards. Leakage to a certain extent occurs, which is reflected by passive devices serving as the PIM sources in the antenna, thus disturbing the normal operation of the antenna. Therefore, the electromagnetic shielding effect of the passive devices can have a significant effect of improving the performance of the electrically regulated antenna system. At present, the conventional application field of alum-glass cloth tape is the field of HVAC (Heating Ventilation Air Conditioning. The alum-glass cloth tape is mainly applied to heat seal veneering and water vapor blocking layers of glass wool, rock wool, mineral wool PEF products, rubber products and other heat insulation materials, and is suitable for the heat seal adhesion of cotton felts, cotton boards, cotton pipes, PEF plate pipes and rubber and plastic plate pipes on the spot, in order to satisfy the heat insulation and water vapor blocking demands of heating and ventilating air pipes and cold and warm water pipes and the heat insulation demands of buildings. The present invention proposes to apply alum-glass cloth tape to the field of radio frequency products, in particular to the electrically regulated antenna system, as an electromagnetic shielding material so as to further improve the electromagnetic shielding effect, and particularly the passive intermodulation shielding effect in a cost-effective manner.

In one embodiment of the present invention, the cable is a ribbon cable, and the shielding layer of the ribbon cable is composed of the alum-glass cloth tape. At present, the motor cables typically used in the electrically regulated antenna system are mainly flexible cables, especially flexible flat cables. The application of the flexible flat cable brings a series of problems: first of all, the price of the flexible flat cable is relatively expensive, thus a cost problem is generated when mass production is required; secondly, the connection of the flexible flat cable with the motor and the printed circuit board requires additional manual soldering, which increases the labor cost; thirdly, since the flexible flat cable achieves single-sided shielding, extra consideration is given to how to route the cables, and in particular, the flexible flat cables need to be arranged next to the reflector board; and in addition, a decoupling capacitor also needs to be added on the flexible flat cable, which in turn complicates the manufacturing process and adds an additional cost. Therefore, by replacing the traditional flexible flat cable, the application of the ribbon cable can avoid the above-mentioned series of problems caused by the application of the flexible flat cable. First of all, the ribbon cable can be cost-effectively obtained; secondly, a quick plug can be arranged on the ribbon cable, so that the ribbon cable can be quickly inserted onto the printed circuit board and the motor without additional manual soldering; and thirdly, the ribbon cable can be twined on the surrounding by a shielding material without thinking too much about the cable routine problem. However, it should not be overlooked herein that the ribbon cable is a sensitive PIM source, that is to say, the ribbon cable reflects the radio waves very significantly. Therefore, the electromagnetic shielding effect of the ribbon cable is very important. However, it should be noted that since the currently used aluminum shielding layer is manufactured at a thickness to enhance the tensile strength, this in turn makes the aluminum shielding layer become harder, especially since the ribbon cable is very flexible. When the aluminum shielding layer is wound onto the ribbon cable (due to the hard exterior and soft interior), the adhesion of the aluminum shielding layer deteriorates to be bent easily, so that a gap is formed between the aluminum shielding layer and the ribbon cable, which in turn will significantly reduce the electromagnetic shielding effect.

Herein, the alum-glass cloth tape is applied to the ribbon cable to serve as the electromagnetic shielding material to address the above problems. First of all, if the alum-glass cloth tape is used as the shielding layer on the ribbon cable, unlike the traditional aluminum shielding layer, the flexibility of the ribbon cable is not changed in this case and the ribbon cable remains well-adhered; secondly, the vertical and horizontal tensile strength of a glass fabric layer in the alum-glass cloth tape is high; therefore there is no need to manufacture a thick aluminum foil layer; thirdly, an adhesive layer in the alum-glass cloth tape has long-lasting adhesion, so frequent maintenance is unnecessary; and in addition, as the alum-glass cloth tape is a commonly used material in the field of HVAC heating, it can be cost-effectively obtained without additional customization.

In one embodiment of the present invention, an insulating tape, preferably a high-temperature insulating tape, is used on the shielding layer. Of course, the high-temperature insulating tape can also be used on other devices or positions of the assembly for adjusting the electrically regulated antenna. Herein, one end of the motor cable, especially the ribbon cable, needs to be connected to the printed circuit board. As mentioned above, since the ribbon cable is flexible, it is quite possible to generate a short circuit with the device thereon when being connected to the printed circuit board, and thus the insulating tape is used on the shielding layer in order to avoid the short circuit.

In one embodiment of the present invention, the aluminum foil layer in the shielding layer is connected with the shell of the motor, preferably connected to form an equipotential body, via a connecting conductor. Herein, the alum-glass cloth tape can be doubled back on the adhesive surface to form the connecting conductor. In addition, the connecting conductor can also be fixed with the shielding layer and the connecting conductor is fixed with the shell of the motor via at least one piece of alum-glass cloth tape (also referred to as a fixing body). Herein, it may be advantageous if the connecting conductor and the fixing body are formed by the alum-glass cloth tape; this is because the material types to be purchased are kept at a relatively low level, which is particularly advantageous for the mass production of the product in order to reduce the cost.

In addition, it has been proven by testing that the electromagnetic shielding effect can be optimized and the influence of the passive intermodulation can be reduced by electrically connecting the aluminum foil layer in the shielding layer and the shell of the motor into an equipotential body. It is relatively simple to test whether the two devices are equipotential or not. If a test point is selected on each of the alum-glass cloth tape and the metal shell of the motor, it is deemed that the two devices are equipotential if no voltage, that is, no potential difference, is tested between the two test points.

In one embodiment of the present invention, the sum of the thicknesses of the aluminum foil layers in the shielding layer is greater than or equal to 20 micrometers. It is known to those skilled in the art that the shielding effect=absorption loss+reflection loss+multiple reflection loss. If the frequency is greater than 100 MHz (the electrically regulated antenna generally belongs to this case), the shielding effect mainly depends on the absorption loss, and the absorption loss is related to the thickness of the shielding material (the thickness of the aluminum foil layer herein) and the skin effect depth. It has been shown that the sum of the thicknesses of the aluminum foil layers can meet the shielding effect requirements for the passive intermodulation under the worst condition (for example, the antenna is applied to 700 MHz), and can comply with relevant industry regulations.

In one embodiment of the present invention, the shielding material is configured to improve the PIM characteristics of the assembly for adjusting the electrically regulated antenna. That is to say, the shielding material, that is, the alum-glass cloth tape, is employed with the sensitive PIM sources in the assembly for adjusting the electrically regulated antenna, so that the external passive intermodulation characteristics of the whole assembly for adjusting the electrically regulated antenna satisfy the relevant industry regulations, and thus the assembly can be applied to the whole electrically regulated antenna system.

In one embodiment of the present invention, the assembly for adjusting the electrically regulated antenna further includes a transmission mechanism, and the transmission mechanism is used for converting the rotational motion of the motor into rectilinear motion to operate and control a phase shifter so as to adjust the parameters of the electrically regulated antenna. The transmission mechanism may be a ball-screw mechanism, a crank block, a cam, a gear rack, and the like. The parameters of the electrically regulated antenna include a downward inclination angle. The phase shifter may also be integrated in the assembly for adjusting the electrically regulated antenna.

A second aspect of the present invention relates to an electrically regulated antenna system, including an electrically regulated antenna and the assembly for adjusting the electrically regulated antenna according to embodiments of the present invention. As described above, the external PIM characteristics of the whole assembly for adjusting the electrically regulated antenna satisfy the relevant industry regulations, so that the passive intermodulation characteristics of the whole electrically regulated antenna system are greatly improved. As a result, the SNR of the system is improved, and the capacity of the electrically regulated antenna system is improved.

A third aspect of the present invention relates to a method for manufacturing an assembly for adjusting an electrically regulated antenna, wherein the assembly for adjusting the electrically regulated antenna includes a control device, a motor and a cable. The control device is connected with the motor via the cable, and a shielding material composed of alum-glass cloth tape is arranged in the assembly for adjusting the electrically regulated antenna. As described above, the alum-glass cloth tape is applied to the assembly for adjusting the electrically regulated antenna to serve as the electromagnetic shielding material to further improve the electromagnetic shielding effect, particularly the PIM shielding effect, in a cost-effective manner.

In one embodiment of the present invention, a method for manufacturing the assembly for adjusting the electrically regulated antenna includes:

Winding the cable, such as a ribbon cable, for at least one revolution, preferably at least three revolutions, with the alum-glass cloth tape so as to form a shielding layer of the cable. An aluminum foil layer in the shielding layer is connected with the shell of the motor, potentially connected to form an equipotential body, via a connecting conductor.

The connecting conductor is fixed with the shielding layer and the connecting conductor is fixed with the shell of the motor via fixing body.

Herein, it may be advantageous that: one piece of alum-glass cloth tape is doubled back on the adhesive surface to form the connecting conductor so as to connect the aluminum foil layer in the shielding layer with the shell of the motor (which may form an equipotential body); and at least one piece of alum-glass cloth tape is used as the fixing body to fix the connecting conductor with the shielding layer and fix the connecting conductor with the shell of the motor.

An insulating tape, preferably a high-temperature insulating tape, may be wound on the shielding layer.

Although only the shielding of the cable is mentioned in the above method steps, it is also applicable to other devices of the assembly for adjusting the electrically regulated antenna. For example, the insulating tape can also be used on other devices or other positions of the assembly for adjusting the electrically regulated antenna. In addition, the connecting conductor and/or the fixing body comprises the alum-glass cloth tape. Therefore, the material types necessary for implementing the method steps are kept at relatively low levels as much as possible in order to reduce costs. One piece of alum-glass cloth tape may be doubled back on the adhesive surface to adhere the adhesive surfaces with each other so as to form the connecting conductor. As a result, the aluminum foil layers are formed on the front and back surfaces of the connecting conductor, thus acting like a conducting wire with a stripped insulting layer. At least one piece of alum-glass cloth tape may also be used for implementing the functions of the fixing body herein, and the fixing body in other forms can also be used, such as a cable clip, etc.

A fourth aspect of the present invention relates to a radio frequency device, wherein the radio frequency device uses alum-glass cloth tape as a shielding material. As described above, the alum-glass cloth tape is applied to the radio frequency device to serve as the electromagnetic shielding material to further improve the electromagnetic shielding effect, particularly the passive intermodulation shielding effect, in a cost-effective manner.

In one embodiment of the present invention, the radio frequency device includes a base station antenna, a radio frequency power amplifier, an active antenna, a distributed antenna system, a remote wireless unit, a filter or a duplexer and other similar devices. The alum-glass cloth tape may be used as the shielding material on at least one of the following locations (which are potential PIM sources): a metal shell, a metal seam, a hole in a reflector board, a cable, a crack, a whisker. The PIM characteristics of the radio frequency devices may be greatly improved in a cost-effective manner.

BRIEF DESCRIPTION OF THE DRAWINGS

The drawings described herein are used for providing a further understanding of the present invention and constitute a part of the present application. The schematic embodiments and the descriptions of the present invention are only used for explaining the present invention and do not constitute improper limitations to the present invention, wherein.

DETAILED DESCRIPTION OF THE EMBODIMENTS

Specific embodiments of the invention will now be described with reference to the drawings, and the drawings show several embodiments of the invention. It should be understood, however, that the present invention may be embodied in many different forms and is not limited to the embodiments described hereinafter; in fact, the embodiments described below are intended to make the disclosure of the present invention be more complete and to present the present scope of the present invention to those skilled in the art sufficiently. It should also be understood that the embodiments disclosed herein can be combined in various ways to provide further more additional embodiments.

It should be understood that the phraseology in the specification is for the purpose of describing particular embodiments only and is not intended to limit the present invention. All terms (including technical and scientific terms) used in the specification have the meaning as commonly understood by those skilled in the art, unless otherwise defined. For the purpose of simplicity and/or clarity, well-known functions or structures may not be described in detail.

The singular forms "a", "an" and "the" used in the specification, unless otherwise indicated, contain the plural forms. The terms "including," "comprising," and "containing" used in the specification indicate the existence of the claimed features, but do not exclude the existence of one or more other features. The terminology "and/or" used in the specification includes any and all combinations of one or more of the associated listed items.

Figure 1:
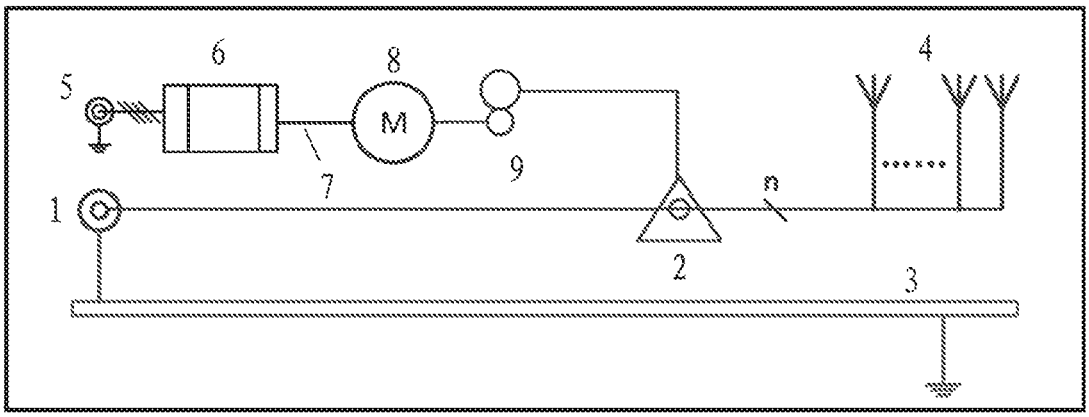
FIG. 1 shows a schematic diagram of an electrically regulated antenna system.

The present invention will now be illustrated with reference to the drawings. FIG. 1 shows a schematic diagram of an electrically regulated antenna system. The electrically regulated antenna system includes an assembly for adjusting an electrically regulated antenna, a radio frequency power input 1, a phase shifter 2, a reflector board 3, a radiator array 4 and the like. The assembly for adjusting the electrically regulated antenna includes an AISG interface 5, a control device 6 (such as a printed circuit board or a driven board), a cable 7, a stepper motor 8 and a transmission mechanism 9. It can be seen herein that, four cables are connected from the AISG interface to the driven board 6, two of which are respectively positive and negative power lines (10 to 30V), and the other two or which are respectively communication lines (for example, RS485 two-wire communication mode). The electrically regulated antenna remote control unit inputs a control signal to the AISG interface 5, the AISG interface 5 inputs the control signal to the driven board, and the driven board triggers a corresponding pulse signal according to the received control signal for driving and controlling the operation of the stepping motor 8. Herein, the rotating speed and the stop position of the stepping motor 8 only depend on the frequency and the pulse number of the pulse signal. When a driver receives a pulse signal, it drives the stepping motor to rotate for a fixed angle according to a set direction, and of course, it is also applicable to the motors of other types. Then, the transmission mechanism, such as a ball-screw mechanism, converts the rotational motion of the stepping motor into linear motion, and the phase shifter is driven by a pull strip to couple arm to perform linear motion or swing motion for changing the power and phase distribution of a collinear array antenna element, changing the amplitudes of a vertical component and a horizontal component and changing the field strength of a synthesized component so as to change the electrical downtilt in the vertical direction of the synthesized wave beam of the electrically regulated antenna.

It is known that there is a series of PIM sources in the electrically regulated antenna system; in particular a motor cable such as a ribbon cable is a very sensitive PIM source that reflects radio waves, and thus can seriously interfere with the normal operation of the antenna. As described above, based on the characteristics of the ribbon cable, such as flexibility, the existing shielding material cannot achieve good shielding effect. Herein, alum-glass cloth tape is applied to the electrically regulated antenna system, in particular the ribbon cable to serve as the shielding material to achieve a satisfactory result. The following is an overview of the construction of the alum-glass cloth tape, the method producing the alum-glass cloth tape serving as a ribbon cable shielding layer 10 and a final shielded ribbon cable together with the shielding layer.

Figure 2:
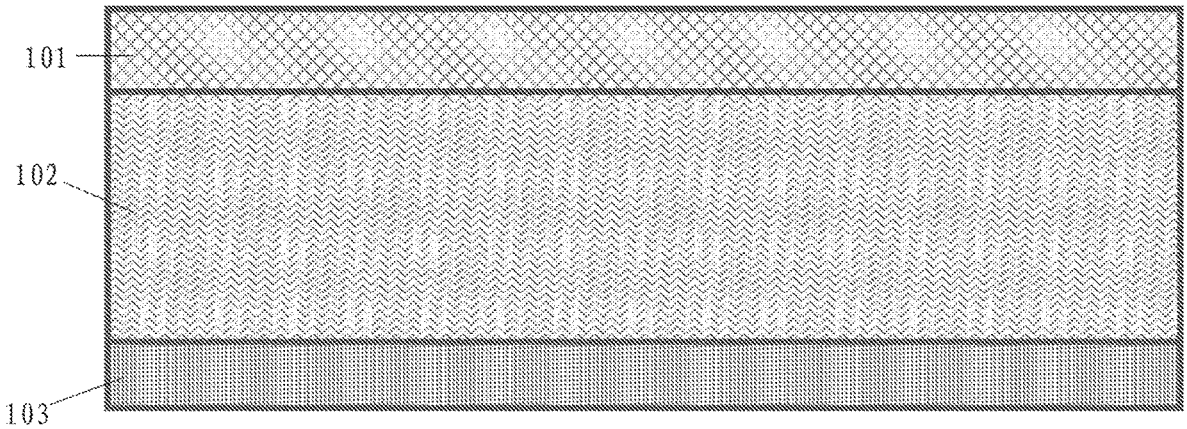
FIG. 2 shows a cross-section view of alum-glass cloth tape.
Figure 3A:
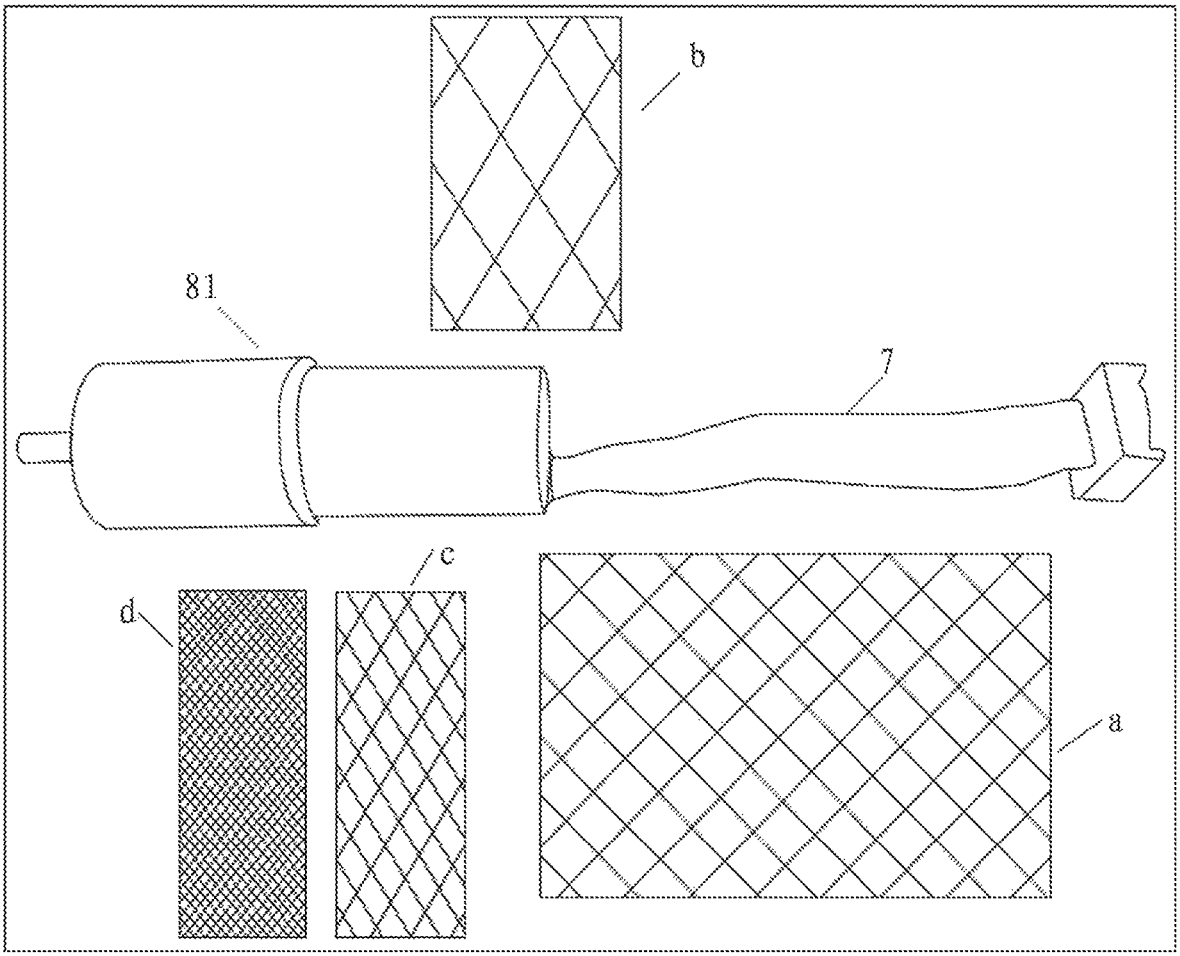
FIGS. 3*a*-3*h* show exemplary method steps of shielding a ribbon cable via alum-glass cloth tape.
Figure 3B:
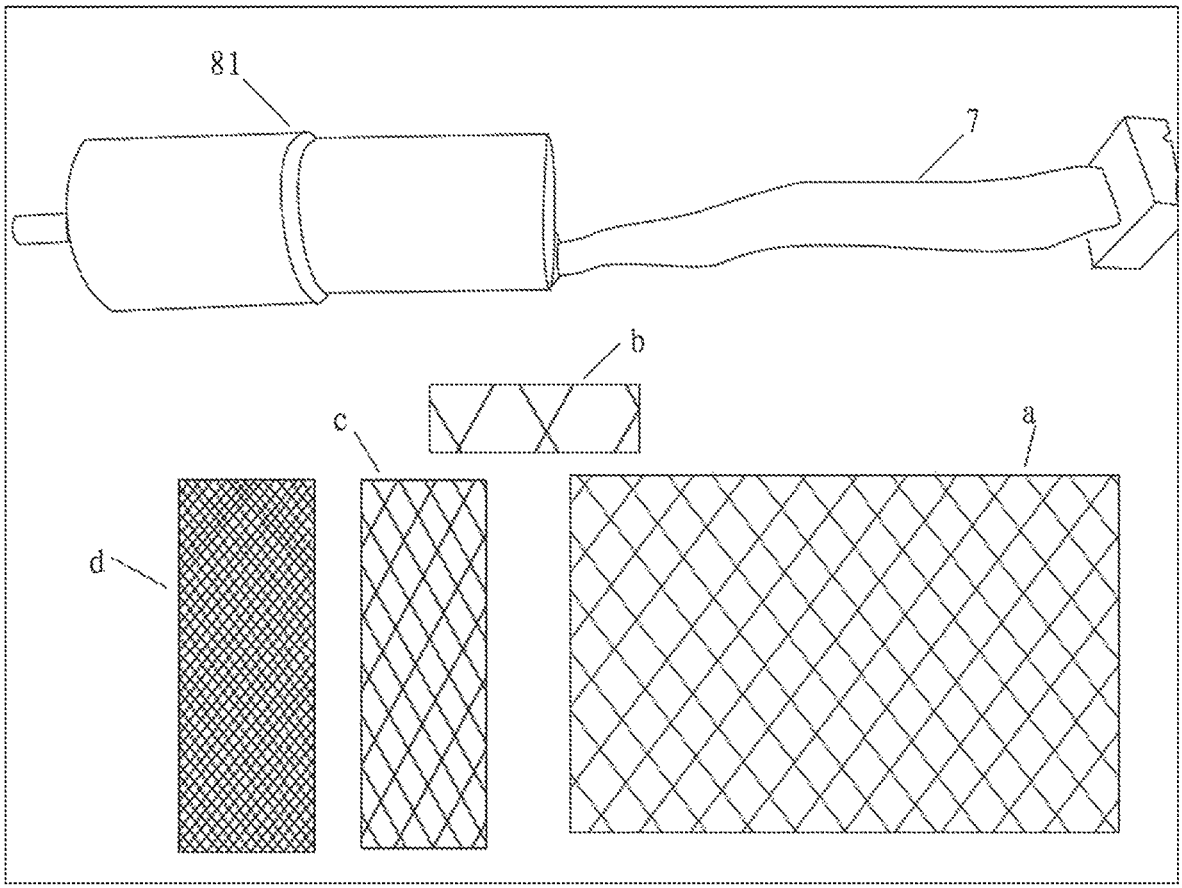
Figure 3C:
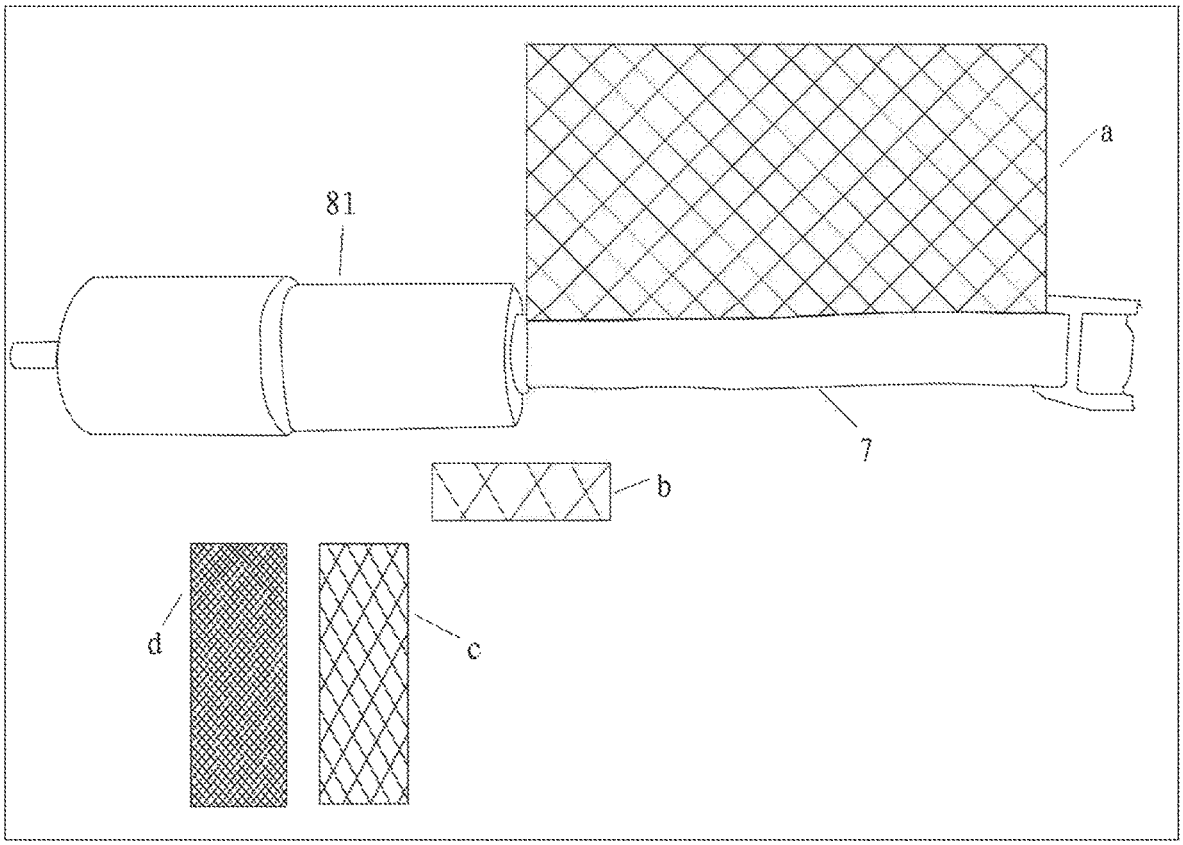
Figure 3D:
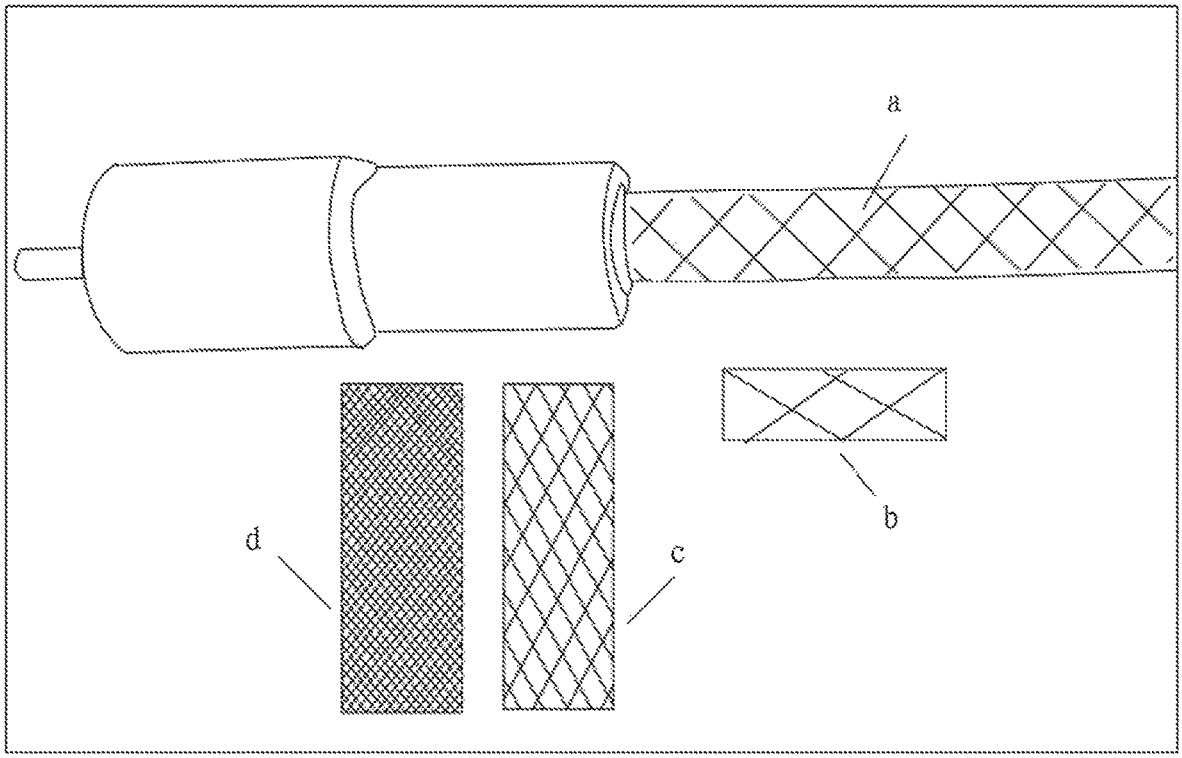
Figure 3E:
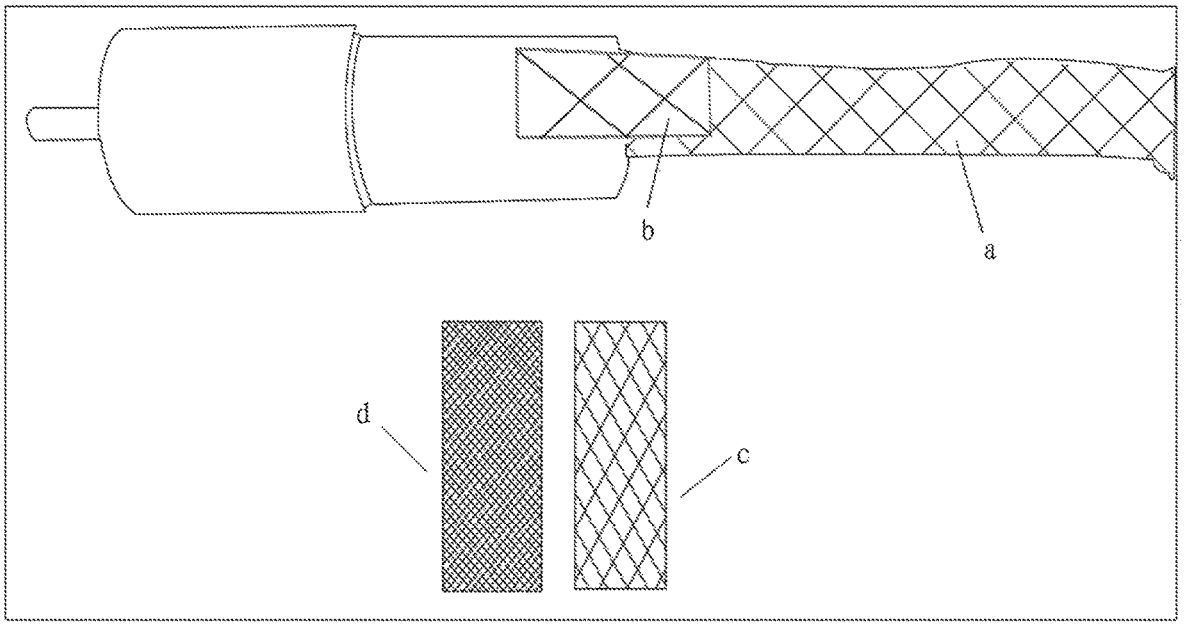
Figure 3F:
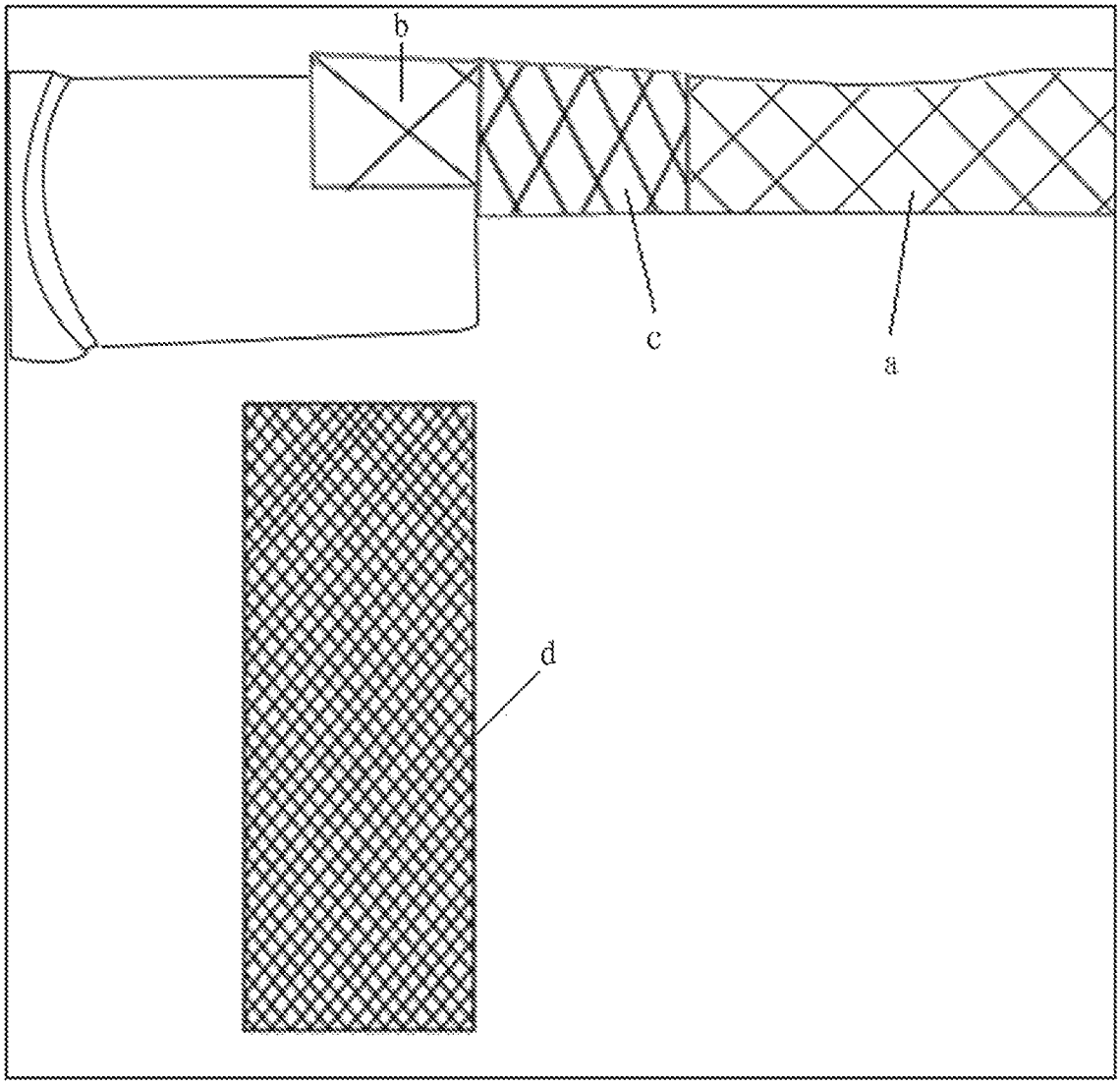
Figure 3G:
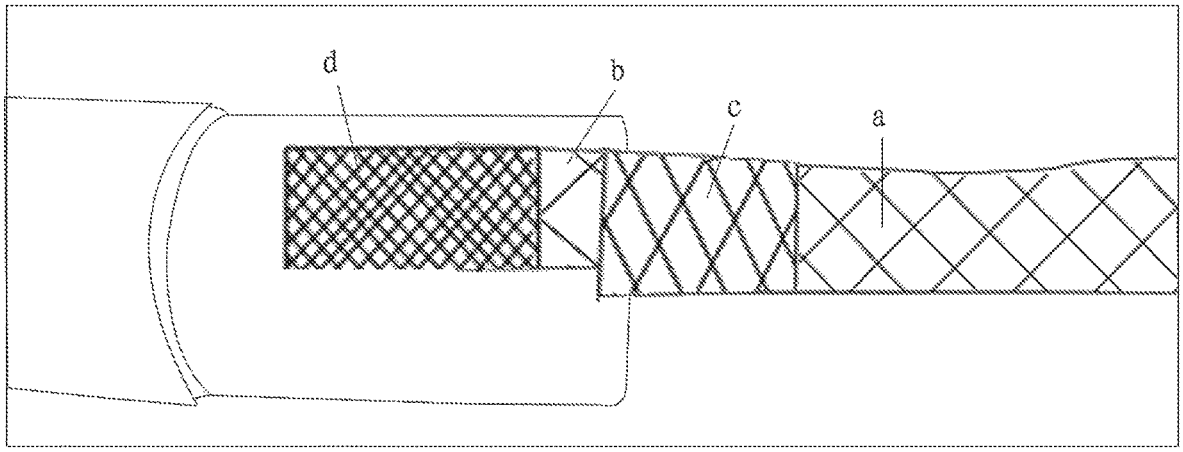
Figure 3H:
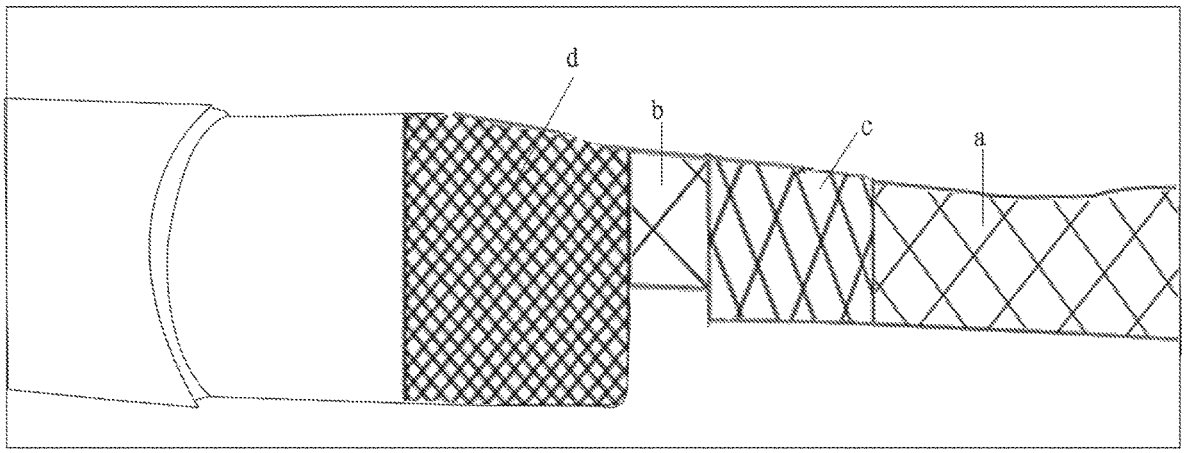

FIG. 2 shows a cross section view of the alum-glass cloth tape. It can be seen that the alum-glass cloth tape includes: an aluminum foil layer 101, a glass fabric layer 102 and an adhesive layer 103. The aluminum foil layer 101 is arranged on the glass fabric layer 102, and the adhesive layer 103 is arranged beneath the glass fabric layer 102 and is adhered on the surface of a corresponding object to be shielded.

The arrangement structure of the alum-glass cloth tape brings a series of advantages. When frequency is greater than 700 MHz, the aluminum foil layer 101 in the alum-glass cloth tape can provide stable absorption loss (greater than 20 dB); the glass fabric layer 102 in the alum-glass cloth tape can provide good tensile strength and ductility, whereby the aluminum foil layer 101 arranged thereon is not subjected to excessive tensile force, and thus can be relatively thinly manufactured on the premise of satisfying the shielding effect. Therefore, compared with the shielding material used in the prior art, the alum-glass cloth tape can achieve the expected shielding effect in a cost-effective manner and better adhesion performance. The adhesive layer can provide long-lasting, reliable and strong adhesive power, so it can function for a long time without frequent replacement, thus reducing maintenance cost. Also, the adhesive layer is low in water vapor permeability and high in water vapor isolation, so that the moistureproof level is high, and the overall applicable temperature range of the alum-glass cloth tape is relatively wide (−40° C. to +120° C.).

The table below shows comparison of the passive intermodulation characteristics on the antenna level at working frequencies of 800 MHz, 850 MHz and 900 MHz in two states of shielding the ribbon cable by using the alum-glass cloth tape and without using the alum-glass cloth tape.

| | 800 MHz 43 dBm | 850 MHz 43 dBm | 900 MHz 43 dBm | |
|---|---|---|---|---|
| First port | 136.1 dBc | 148.6 dBc | 117.3 dBc | Shielding the ribbon cable without using the alum-glass cloth tape |
| Second port | 141.1 dBc | 151.1 dBc | 130.6 dBc | |
| First port | 166.7 dBc | 152.5 dBc | 158.4 dBc | Shielding the ribbon cable by using the alum-glass cloth tape |
| Second port | 172.1 dBc | 155.8 dBc | 161.6 dBc | |

Herein, a 43 dBm (20 W) emission sources is used for recording relative attenuation in the two states of shielding the ribbon cable by using the alum-glass cloth tape and without using the alum-glass cloth tape at the working frequencies of 800 MHz, 850 MHz and 900 MHz. In general, when the relative attenuation is higher than 150 dBc, it is deemed that the PIM characteristics are good. It can be seen that the relative attenuation detected on the first port and the second port is lower than 150 dBc in the case of shielding the ribbon cable without using the alum-glass cloth tape, that is to say, the PIM characteristics are inadequate. In contrast, all the relative attenuation detected on the first port and the second port is greater than 150 dBc in the case of shielding the ribbon cable by using the alum-glass cloth tape, (that is to say, the PIM characteristics are good). Therefore, it can be quantitatively demonstrated that the alum-glass cloth tape has a good shielding effect via the above experimental data, and particularly when the alum-glass cloth tape is used as the shielding layer for shielding the ribbon cable, the shielding effect can be significantly improved.

The calculation of the thickness of the aluminum foil layer necessary for the 60 dB absorption loss (i.e., 60 dB attenuation) at 700 MHz when the alum-glass cloth tape is used as the shielding layer of the ribbon cable of the motor will be introduced below. Firstly, as mentioned above, the shielding effect (SE)=absorption loss (A)+reflection loss (R)+multiple reflection loss (B), and the shielding effect depends mainly on the absorption loss at 700 MHz. The absorption loss can be calculated as follows:

$$A = 20\log_{10}e^{\alpha t} = 8.6859\alpha t = 8.6859\frac{t}{\delta}\text{dB},$$

wherein, t represents shielding material thickness, and δ represents the skip effect depth. Herein, $$\alpha = \frac{1}{\delta} = \sqrt{\pi f \mu \sigma}\text{, wherein } \sigma = \frac{1}{\rho}.$$

Therefore, if the resistivity and relative permeability of aluminum and the application frequency are known, the corresponding skin effect depth can be calculated, and then the necessary thickness of the aluminum foil layer can be calculated. Specific parameters are shown in the following table:

| | |
|---|---|
| Select the shielding material | Aluminum |
| Operation frequency (f) | 700 MHz |
| Resistivity (ρ) | $2.6548 \times 10^{-8}$ Ω/m |
| Relative permeability ($\mu_r$) | 1.00002 |
| Skin effect depth (δ) | 3.10 μm |
| Required absorption loss | 60 dB |
| Required shielding material thickness | 21.42 μm |

The 60 dB absorption loss can be achieved when the calculated metal media thickness, that is, the required aluminum foil layer thickness, is 21.42 μm. If the thickness of the aluminum foil layer in each piece of alum-glass cloth tape is 7 μm, three layers of alum-glass cloth tape are needed to satisfy the demand.

FIGS. 3*a*-3*h* show exemplary method steps of shielding the ribbon cable via the alum-glass cloth tape. Specifically, the method steps of forming an equipotential body between the shielding layer 10 and the shell 81 of the motor are shown. The method steps described herein are merely exemplary and the order of the method steps and the specific operations may be adapted or replaced by other alternatives.

Step 1 (referring to FIG. 3*a*), preparing four pieces of alum-glass cloth tape (the reference numbers are respectively a, b, c, d);

step 2 (referring to FIG. 3*b*), doubling back the alum-glass cloth tape b on the adhesive surface to form a connecting conductor, wherein the connecting conductor functions as a conducting wire with a stripped insulating layer;

step 3 (referring to FIG. 3*c*), continuously winding the alum-glass cloth tape a on the ribbon cable for at least three revolutions;

step 4 (referring to FIG. 3*d*), forming the shielding layer of the ribbon cable;

step 5 (referring to FIG. 3*e*), arranging the connecting conductor formed in step 2 between the shielding layer of the ribbon cable and the shell of the motor, so that the two form an equipotential body;

step 6 (referring to FIG. 3*f*), firmly wrapping (i.e., firmly adhering and fixing) the connecting conductor and the shielding layer of the ribbon cable by using the alum-glass cloth tape c;

step 7 (referring to FIG. 3*g*), firmly wrapping (i.e., firmly adhering and fixing) the connecting conductor and the shell of the motor by using the alum-glass cloth tape d;

step 8 (referring to FIG. 3*h*), forming an equipotential body between the aluminum foil layer in the shielding layer of the ribbon cable and the shell of the motor (in order to verify whether an equipotential body is formed, a test point can be respectively selected on each of the alum-glass cloth tape and the shell of the motor, and it is deemed that the two are equipotential if no voltage, i.e., no potential difference, is detected between the two test points by using a universal meter). The test proves that the electromagnetic shielding effect can be further improved by forming an equipotential body between the aluminum foil layer of the shielding layer and the shell of the motor.

Figure 4:
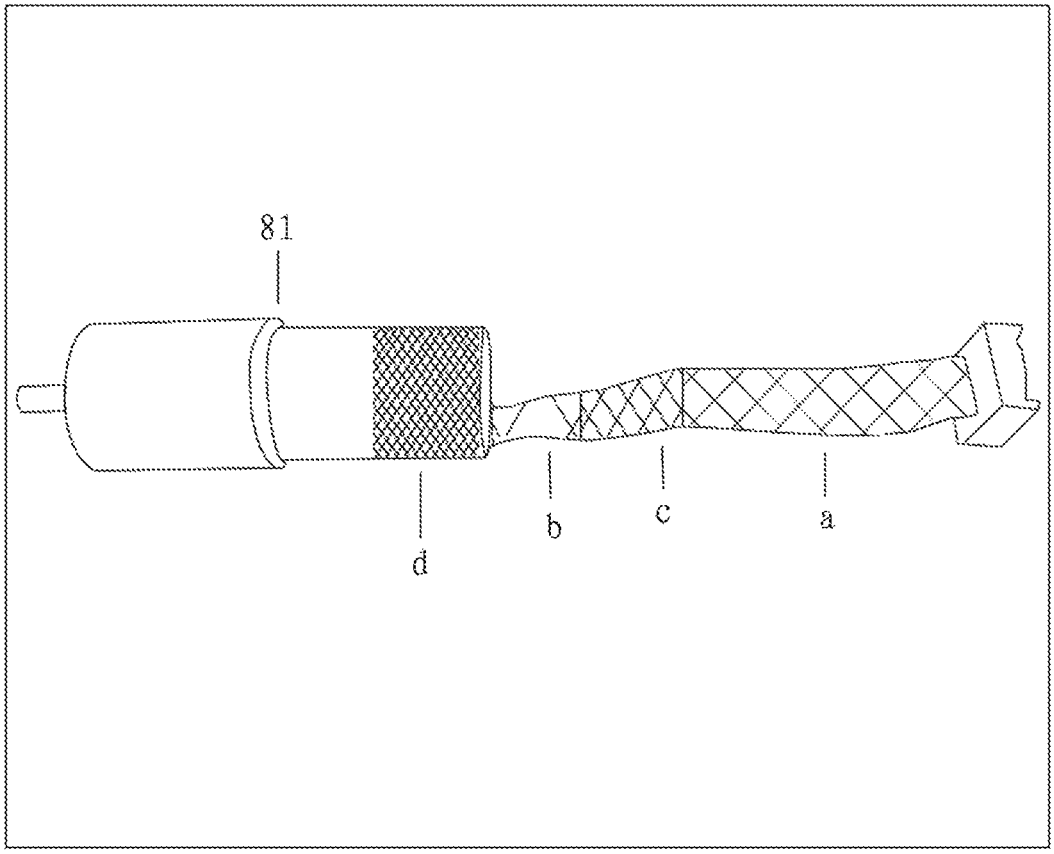
FIG. 4 shows a shielding schematic diagram of an assembly for adjusting an electrically regulated antenna.

FIG. 4 shows a shielding schematic diagram of an assembly for adjusting an electrically regulated antenna. It can be seen from the figure that a connecting conductor composed of alum-glass cloth tape b is connected between the shielding layer (namely, the alum-glass cloth tape a) of the ribbon cable and the shell 81 of the motor, and thus the shielding layer of the ribbon cable and the shell 81 of the motor can be considered as being equipotential if the impedance of the connecting conductor is ignored. In addition, it can also be seen that a piece of alum-glass cloth tape is used as fixing body c to be adhered on a contact section of the connecting conductor and the shielding layer of the ribbon cable for fixing the connecting conductor with the shielding layer of the ribbon cable. Another piece of alum-glass cloth tape d is also used as the fixing body to be adhered on the contact section of the connecting conductor and the shell 81 of the motor for fixing the connecting conductor with the shell of the motor. Of course, any other form of connecting conductor and/or fixing body is also conceivable.

Figure 5:
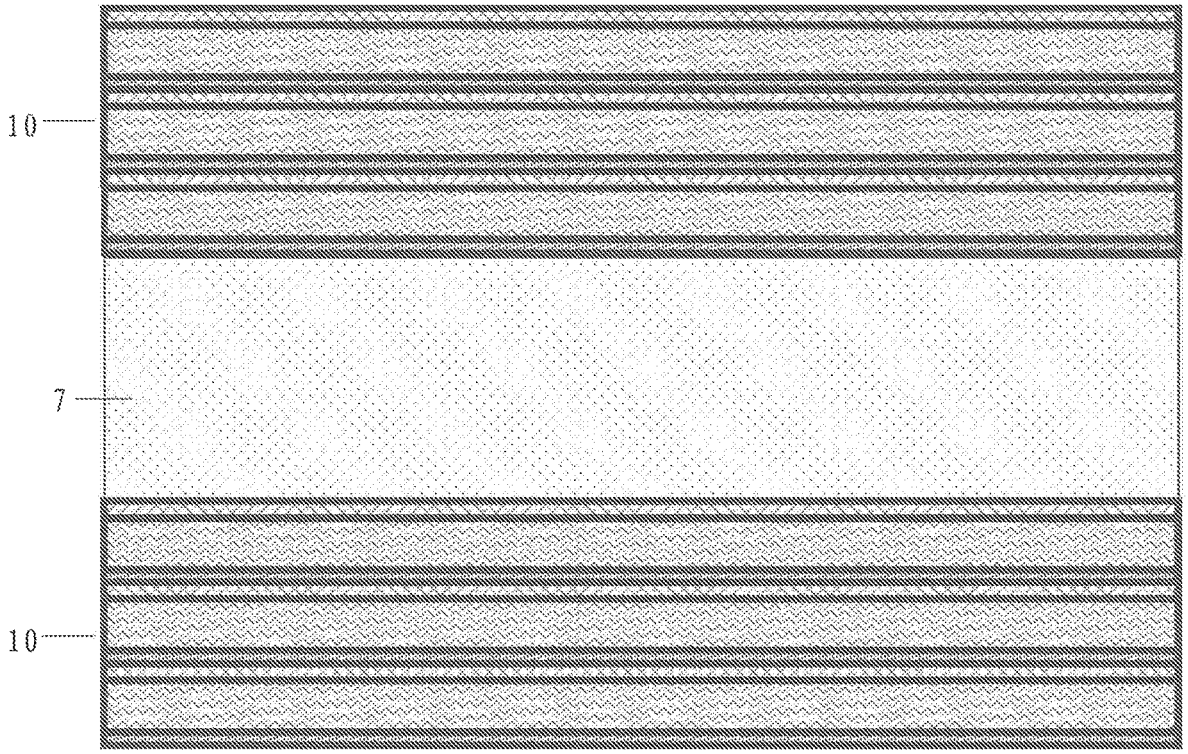
FIG. 5 shows a cross-section view of the shielded ribbon cable.

FIG. 5 shows a cross section view of the shielded ribbon cable. Based on the above quantitative calculation, it can be obtained that, in the worst case, namely at 700 MHz, in order to achieve the 60 dB absorption loss, at least three layers of alum-glass cloth tape are may satisfy the demand (e.g., the thickness of the aluminum foil layer in each piece of alum-glass cloth tape is 7 μm). It can be seen from FIG. 4 that three layers of alum-glass cloth tape as shown in FIG. 2 (i.e., three aluminum foil layers, three layers of glass fabric and three adhesive layers are provided respectively) are wound onto the ribbon cable 7, wherein the sum of the thicknesses of the three aluminum foil layers can achieve the expected absorption loss, the tensile strength of the shielding layer can be further improved due to the use of the three layers of glass fabric, the lowest layer in the three adhesive layers is adhered on the ribbon cable 7, and the remaining two layers are adhered on the aluminum foil layers of the alum-glass cloth tape arranged below. Herein, the three layers of alum-glass cloth tape are continuously wound, that is, formed by continuously winding the ribbon cable 7 with a large piece of alum-glass cloth tape, and thus the aluminum foil layers in the three layers of alum-glass cloth tape are equipotential.

Although the exemplary embodiments of the present invention have been described, those skilled in the art will appreciate that various changes and modifications of the exemplary embodiments of the invention can be made without departing from the spirit and scope of the present invention in nature. Therefore, all the changes and modifications are included in the protection scope of the present invention as defined in the claims. The present invention is defined by the appended claims, and the equivalents of these appended claims are also included therein.

The invention claimed is:

1. An assembly for adjusting an electrically regulated antenna, wherein the assembly for adjusting the electrically regulated antenna comprises a control device, a motor and a cable, wherein the control device is connected with the motor via the cable, and further comprising a shielding material in the assembly for adjusting the electrically regulated antenna which comprises alum-glass cloth tape.

2. The assembly for adjusting the electrically regulated antenna of claim 1, wherein the cable is a ribbon cable, and the shielding material of the ribbon cable is composed of the alum-glass cloth tape.

3. The assembly for adjusting the electrically regulated antenna of claim 2, wherein at least one aluminum foil layer in the shielding material is connected with a shell of the motor via a connecting conductor.

4. The assembly for adjusting the electrically regulated antenna of claim 2, wherein the sum of the thicknesses of the at least one aluminum foil layer in the shielding material is greater than or equal to 20 micrometers.

5. An electrically regulated antenna system, comprising an electrically regulated antenna and the assembly for adjusting the electrically regulated antenna of claim 1.

6. The assembly of claim 1 in combination with a radio frequency device.

7. The combination of claim 6, wherein the radio frequency device comprises at least one of the following components: a base station antenna, a radio frequency power amplifier, an active antenna, a distributed antenna system, a remote wireless unit, a filter, or and a duplexer.

8. The combination of claim 6, wherein the alum-glass cloth tape is used as the shielding material on at least one of the following places: a metal shell, a metal seam, a hole in a reflector board, a cable, a crack, or a whisker.

9. A method for manufacturing an assembly for adjusting an electrically regulated antenna, the method comprising:

providing an assembly for adjusting an electrically regulated antenna comprising a control device, a motor and a cable, wherein the control device is connected with the motor via the cable;

applying alum-glass cloth tape onto the cable, Wherein the cable is wound for at least one revolution with the alum-glass cloth tape so as to form a shielding layer of the cable;

connecting an aluminum foil layer in the shielding layer with a shell of the motor via a connecting conductor; and fixing the connecting conductor with the shielding layer and fixing the connecting conductor with the shell of the motor via a fixing body.

10. The method of claim 9, further comprising:

doubling back a piece of alum-glass cloth tape on an adhesive surface thereof to form the connecting conductor so as to connect the aluminum foil layer in the shielding layer with the shell of the motor; and using at least one piece of alum-glass cloth tape as the fixing body to fix the connecting conductor with the shielding layer and fix the connecting conductor with the shell of the motor.

* * * * *